United States Patent [19]

Card et al.

[11] Patent Number: 4,619,212

[45] **Date of Patent: * Oct. 28, 1986**

[54] TUFTING MACHINE AND METHOD OF TUFTING FOR PRODUCING MULTIPLE ROWS OF TUFTS WITH SINGLE LENGTHS OF YARN

[76] Inventors: Roy T. Card, 4012 Creekwood Ter., Chattanooga, Tenn. 37421; Joseph L. Card, 1515 Edgewood Cir., Chattanooga, Tenn. 37405

[ * ] Notice: The portion of the term of this patent subsequent to Apr. 3, 2001 has been disclaimed.

[21] Appl. No.: 723,266

[22] Filed: Apr. 15, 1985

Related U.S. Application Data

[63] Continuation of Ser. No. 592,384, Mar. 22, 1984, which is a continuation of Ser. No. 496,010, May 19, 1983, Pat. No. 4,440,102.

[51] Int. Cl.[4] ..... D05C 15/30; D05C 17/02

[52] U.S. Cl. ..... 112/266.2; 112/80.01; 112/80.3; 112/80.4

[58] Field of Search ..... 112/79 R, 79 A, 266.2, 112/266.1, 262.1, 79 FF, 410, 411

[56] References Cited

U.S. PATENT DOCUMENTS

| | | | |
|---|---|---|---|
| 3,026,830 | 3/1962 | Bryant et al. | 112/79 A |
| 3,109,395 | 11/1963 | Battey et al. | 112/79 A |
| 3,301,205 | 10/1976 | Card | 112/79 R |
| 3,396,687 | 8/1968 | Nowicki | 112/79 A |
| 3,577,943 | 5/1971 | Watkins | 112/79 R |
| 3,601,071 | 8/1971 | Watkins et al. | 112/410 X |
| 4,366,761 | 1/1983 | Card | 112/79 A |
| 4,501,212 | 2/1985 | Slattery | 112/266.2 |

*Primary Examiner*—H. Hampton Hunter

*Attorney, Agent, or Firm*—Newton, Hopkins & Ormsby

[57] ABSTRACT

A laterally shiftable needle bar of a tufting machine, carrying a plurality of laterally spaced needles, is reciprocated in a vertical path for simultaneously inserting loops of yarn, carried by the needles, through a base fabric, the fabric being fed in a linear longitudinal path beneath the needles. Each needle has an individual looper below the base fabric, in registery and cooperating with the needle for engaging and temporarily holding the loop of yarn, inserted by the needle through the base fabric, as the needle is retracted.

During a first portion of a cycle of the needle bar, prior to the insertion of the needles through the base fabric, a needle bar shifting assembly shifts the needle bar laterally, in one direction or the other. Then, after the needles have penetrated the base fabric, the needle bar shifting assembly shifts the needle bar laterally in an opposite direction, so as to cause the needles to move the penetrated portion of the base fabric laterally out of its normal linear path and align the needles with their loopers beneath the base fabric for engagement of the loops by the loopers, as the needles are withdrawn vertically from the base fabric. The resiliency of the base fabric returns the shifted portion of the base fabric to its original linear path across the machine and the yarn inserting cycle is then repeated. By appropriate manipulating of the lateral shifting of the needle bar one or, indeed, a plurality of longitudinal rows of tufts are produced by each needle and its individual looper.

7 Claims, 18 Drawing Figures

TUFTING MACHINE AND METHOD OF TUFTING FOR PRODUCING MULTIPLE ROWS OF TUFTS WITH SINGLE LENGTHS OF YARN

This is a continuation of application Ser. No. 592,384, filed Mar. 22, 1984, which was a continuation of application Ser. No. 496,010, filed on May 19, 1983, now U.S. Pat. No. 4,440,102, dated Apr. 3, 1984.

BACKGROUND OF THE INVENTION

1. Field of the Invention

This invention relates to a tufting machine and method of producing tufts in a base fabric and is more particularly concerned with a tufting machine and method of tufting for producing multiple rows of tufts with single lengths of yarn.

2. Description of the Prior Art

In the past, tufting machines with laterally shiftable needle bars have been devised. U.S. Pat. Nos. 3,026,830 issued Mar. 27, 1962 to Bryant et al.; 3,109,395 issued Nov. 5, 1963 to Batty et al.; 3,396,687 issued Aug. 13, 1968 to Nowicki and my U.S. Pat. No. 4,366,761 issued Jan. 4, 1983 all disclose tufting machines with laterally shiftable needle bars so as to permit a needle to selectively operate with one of two or more adjacent loopers. Of those patents listed above, U.S. Pat. No. 3,026,830 to Bryant et al. discloses a tufting machine which uses a disc shaped cam, the rotation of which is synchronized with the needle operation so as to shift the needle bar laterally in timed relationship to the operation of the needles. The prior art machines disclosed in the above-listed patents, all must be shifted in needle gauge increments and must therefore have quite close tolorances so that in one position all needles are in registry with a prescribed set of loopers and when shifted to another position the same needles are all in registry with another set of loopers.

Also, zig-zag tufted fabrics have been produced by shifting the base fabric or backing material by laterally moving a support beneath the needle bar. In such an operation, neither the needle bars nor the loopers are shifted. U.S. Pat. Nos. 3,577,943 and 3,301,205 show machines for doing this type of tufting.

In the past, narrow gauge tufting machines, because of the limited space between adjacent needles, have been restricted to using small diameter yarns. Such small diameter yarns are expensive to produce, break easily and do not bloom after tufting, as well as the comparable larger diameter yarns. The present invention is particularly suited to producing narrow gauge tufted products using larger diameter yarns than heretofore used, since one needle will produce two or more longitudinal rows of tufting.

In the past, the gauge of combination cut and loop pile tufting machines have been limited as to the narrowness of the gauge, due to the necessity for access to the looper assembly required for each needle. The present invention is particularly suited for use in such combination machines because it can produce narrow gauge goods without the necessity of a needle for each longitudinal row.

SUMMARY OF THE INVENTION

Briefly described, the apparatus of the present invention includes a conventional tufting machine through which a backing material is fed in a linear path across the bed of the tufting machine, so that successive transverse increments of the backing material are positioned beneath a transverse row of needles carried by the needle bar. The conventional tufting machine also has loopers below and in vertical alignment or registry with the side of the needle for engaging, respectively, the loops of yarns inserted through the backing material by the needles.

A needle bar shifting assembly shifts the needle bar laterally back and forth during only a portion of the cycle of the needle bar, between the time the needles are retracted from the fabric and the time they reach bottom dead center, whereby the needles are in a laterally shifted condition, offset from alignment with the loopers, when they enter the fabric and are then moved back into their aligned or in registry positions, with their loopers, before they reach the position of their stroke in which the loopers engage and hold the inserted loops of yarn.

The needles are withdrawn in a straight vertical path and the natural resiliency of the backing material usually returns the transverse increment of backing material, which was laterally shifted to its normal linear path of movement.

The needle bar is usually shifted first laterally in one direction by about one-fourth the gauge of the machine, during a first down stroke of the needles, and, then, laterally by about one-fourth the gauge of the machine in the other direction, during the first portions of a second or alternate down stroke so that successive increments of the backing material are shifted in opposite directions by the penetrating needles whereby each needle and looper combination produces two longitudinal rows of tufts with the successive tufts. The amount of lateral shifting, however, can be varied, as desired.

The needle bar shifting assembly includes a shifting bar connected to the needle bar so that the needle bar is shifted thereby. The needle bar shifting assembly includes a transversely moveable shifting bar, the end of which carries a plurality of spaced guide rollers which form a guide for a vertically disposed shifting bar follower. The shifting bar follower is fixed to the needle bar so that it is reciprocated vertically therewith, within the path defined by the rollers. Lateral movement of the shifting bar, moves the vertically reciprocating follower and needle bar laterally during their vertical reciprocation. Spaced cam followers on the shifting bar ride along diametrically opposed portions of the periphery of a cam or camming wheel or plate which has alternate recesses and lobes which are equally circumferentially spaced along the periphery of the camming plate. The cam is rotated in synchronization with the reciprocation of the needle bar to shift the needle bar as described above.

Accordingly, it is an object of the present invention to provide a tufting machine and process of tufting which will produce multiple rows of tufts with a single length of yarn carried by a single needle.

Another object of the present invention is to provide a tufting machine which, for the gauge of carpeting produced, is inexpensive to manufacture, durable in structure and efficient in operation.

Another object of the present invention is to provide a tufting machine whch can sew two or more longitudinal rows of tufts using a single needle and single looper.

Another object of the present invention is to provide a tufting machine which requires no special adjustment for enabling a single needle to sew a plurality of longitudinal rows of tufts in a backing material.

Another object of the present invention is to provide a method and apparatus of tufting wherein a plurality of dense longitudinal rows of tufting can be produced using a relatively wide gauge machine.

Another object of the present invention is to provide an apparatus for producing, comparatively inexpensively, a finer gauge tufted product.

Another object of the present invention is to provide a process of tufting wherein the holes, created in the backing material for the tufts, are provided with a better spacing than heretofor provided.

Another object of the present invention is to provide an apparatus and method of tufting wherein a narrow gauge fabric is produced using larger diameter yarn than has heretofor been used.

Another object of the present invention is to provide a tufting process and apparatus which will create back stitches over the warp yarns and filling yarns of a woven backing material, thereby providing a relatively stronger tufted product.

Another object of the present invention is to provide an apparatus and method of tufting which will give a better distribution of tufts in the base fabric.

Another object of the present invention is to provide a method and apparatus of tufting which is particularly useful in producing selectively loop and cut pile fabric, the apparatus and method permitting greater space between adjacent needles for receiving the loopers.

Another object of the present invention is to provide a tufted product with a stronger backing material and larger diameter yarn.

Other objects, features and advantages of the present invention will become apparent from the following description when taken in conjunction with the accompanying drawings wherein like characters of reference designate corresponding parts throughout the several views.

DESCRIPTION OF THE PREFERRED EMBODIMENT

Figure 1:
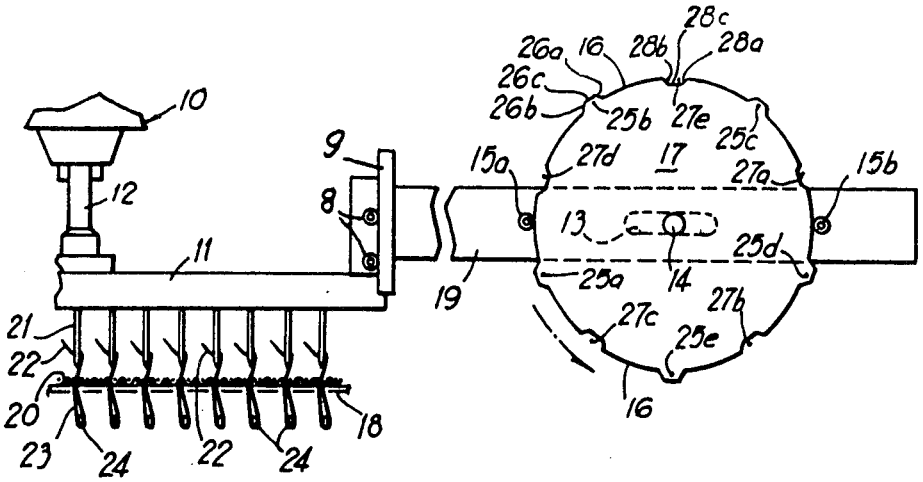
FIG. 1 is a partially broken away side elevational view of a portion of a shiftable needle bar tufting machine constructed in accordance with the present invention, the cam and a portion of the shifting bar being rotated 90° for clarity.

Referring now in detail to the embodiment chosen for the purpose of illustrating the present invention, numeral 10 denotes generally a tufting machine of the type found in U.S. Pat. No. 3,026,830 issued to Clifford Aldine Bryant, Robert F. Hackney, and Otis C. Payne, all of Dalton, Ga., on Mar. 27, 1962, entitled Tufting Machine and Method for Producing Multi-Color Designs in Carpeting and the Like. This tufting machine 10 is of the type having a transversely disposed needle bar 11 which is reciprocated vertically by means of reciprocating piston rods 12 and is shifted laterally by means of a needle bar shifting assembly which includes a transversely moveable shifting bar 19, the end of which carries a plurality of spaced guide rollers 8 which form a guide for a vertically disposed shifting bar follower 9. The shifting bar follower 9 is fixed by its lower end portion to the needle bar 11 so that it is reciprocated vertically therewith, within the path defined by the rollers 8. Lateral movement of the shifting bar 11, moves the vertically reciprocating follower 9 and needle bar 11 laterally during their vertical reciprocation, in its central portion, with a slot 13 surrounding a drive shaft 14. The shift bar 19 is reciprocated laterally by means of a pair of spaced, cam followers **15*a* and 15*b* which project sidewise from bar 19. The cam followers 15*a* and 15*b* ride on the diametrically opposed peripheral portions of the periphery 16 of a disc shaped cam or camming plate 17. The disc shaped cam 17, in turn, is carried by the shaft 14 rotated in timed or synchronized relationship to the reciprocation of the reciprocating shaft 12, i.e., needle bar 11, so that upon one cycle of reciprocation from top dead center back to top dead center of the needle bar 11, the or cam 17 will have been rotated through 36° or one tenth a revolution of the cam 17**.

It will be understood by those skilled in the art that the base fabric or backing material 20 is fed in a longitudinal linear path over a bed 18 on the tufting machine 10 so that successive transverse increments of the backing material are beneath the reciprocating needle bar 11 and so that the needle bar 11 extends transversely with respect to the linear longitudinal path of travel of the base fabric or backing material 20. Backing material 20 is fed intermittently by rolls (not shown) disposed on the side of the tufting machine 10 and thus, a successive increment of the backing material 20 is disposed below the needle bar 11 upon each cycle of the machine.

As in the conventional tufting machine, the needle bar 11 is provided with a plurality of evenly spaced, parallel, downwardly extending, tufting needles 21, which are arranged in one or a plurality of transverse rows. For each needle 21, there is one and only one associated looper 24 in a transversely fixed position for loop engaging action and each needle 21 is in its normal unshifted condition in registry with its looper, or is brought into a position where one side of the needle is in alignment with its associated looper 24 before the needle 21 reaches the bottom dead center position for the needles 21. Yarns 22 respectively pass through the eyes adjacent to the points of the needles 21, so that when the needle bar 11 is moved from its top dead center position, downwardly, points of the needles 21 simultaneously penetrate a transverse increment of the backing material 20 and insert their loops or yarn 22 through the backing material 20. When the needles 21 penetrate the backing material 20 sufficiently, the loops 23 of the yarns 22, are formed in and beneath the base material 20, and these loops 23 are respectively caught by the loopers 24 when the eyes of needles 21 approach bottom dead center, the loopers 24 catching and retaining the loops 23 in a conventional way and holding them for a sufficient time to permit the needles to be withdrawn in axial, vertical, linear, parallel paths from the backing material 20.

According to the present invention, the periphery or peripheral surface 16 of the circular or disc shaped cam 17 is provided with an odd number of lobes 25*a*, 25*b*, 25*c*, 25*d* and 25*e*, equally spaced circumferentially around cam 17. Each lobe 25*a*, 25*b*, 25*c*, 25*d* and 25*e* has an inclined outwardly protruding leading edge or surface 26*a* and an inclined inwardly protruding trailing edge or surface 26*b* the outer ends of which are joined by a flat or concentrically arcuate, central surface 26*c*. The height of each lobe 25*a*, 25*b*, 25*c*, 25*d* and 25*e* in the preferred embodiment is equal to approximately one-fourth the gauge of the tufting machine, i.e., one-fourth the transverse distance between the axis of one needle 21 and the axis of the adjacent needle 21. Each pair of surfaces 26*a* and 26*b* tapers outwardly.

Midway circumferentially, between each of the lobes 25*a*, 25*b*, 25*c*, 25*d* and 25*e* are a like number of recesses or valleys 27*a*, 27*b*, 27*c*, 27*d* and 27*e*, the recesses 27*a*, 27*b*, 27*c*, 27*d* and 27*e* being diametrically opposed to the lobes 25*a*, 25*b*, 25*c*, 25*d* and 25*e*, respectively. Furthermore, each recess 27*a*, 27*b*, 27*c*, 27*d* and 27*e* has an inclined inwardly protruding leading edge or surface 28*a* and an inclined trailing edge or surface 28*b* which tapers inwardly, the inner ends of these edges 28 and 28*b* being joined by a flat or concentric e.g., arcuate central surface 28*c*. The depth of each valley 27*a*, 27*b*, 27*c*, 27*d* and 27*e* corresponds to the height of its associated diametrically opposed lobe 25*a*, 25*b*, 25*c*, 25*d* and 25*e*, whereby each time a lobe and a valley are in contact with a cam follower 15*a* or 15*b* it causes a laterally shifting of the shift bar 19 by a distance which is approximately one-fourth the distance between adjacent needles 21. The shifting in both directions is essentially over a period of less than one-half the period of the downstroke of the needle 21. Also, the initial shifting in one direction must occur while the needles 21 are retracted from the base material 20, i.e., prior to the penetration of the needles 21 into the backing material 20. The subsequent shifting in the other direction must occur after the needles 21 have penetrated the backing material 20, but prior to bottom dead center, i.e., the time that the hooks of the loopers 24 extend into the loops 23 of the yarns 22.

Figure 2:
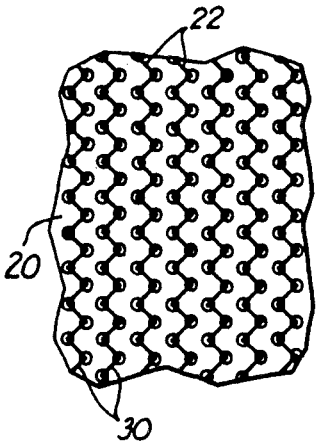
FIG. 2 is a fragmentary, schematic, bottom plan view of a tufted product produced according to the present invention.
Figure 3:
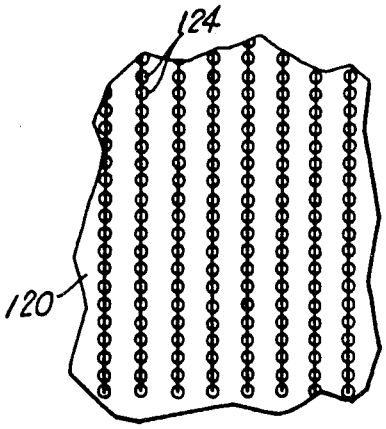
FIG. 3 is a fragmentary, schematic, top plan view of a prior art tufted product comparable to the tufted product depicted in FIG. 2.

In FIG. 2 it is seen that, when using the cam 17, adjacent pairs of longitudinal rows of tufts are produced by each individual yarn 22 the back stitches 30 being in a zig zag fashion. The back stitches 30 extending diagonally in one direction and then diagonally in the other, between successive holes created by each needle 21 in the backing material 20. The tufts formed by loops 23 are, thus, staggered in each pair of longitudinal rows of tufts in the backing material and are also in parallel transverse rows. Contrary to the in line longitudinal holes 124 of the prior art, the staggered holes are not as closely adjacent to each other. Thus, the backing material 20 will not split as readily, when stretched for laying, as the comparable prior art backing material 120.

Figure 4:
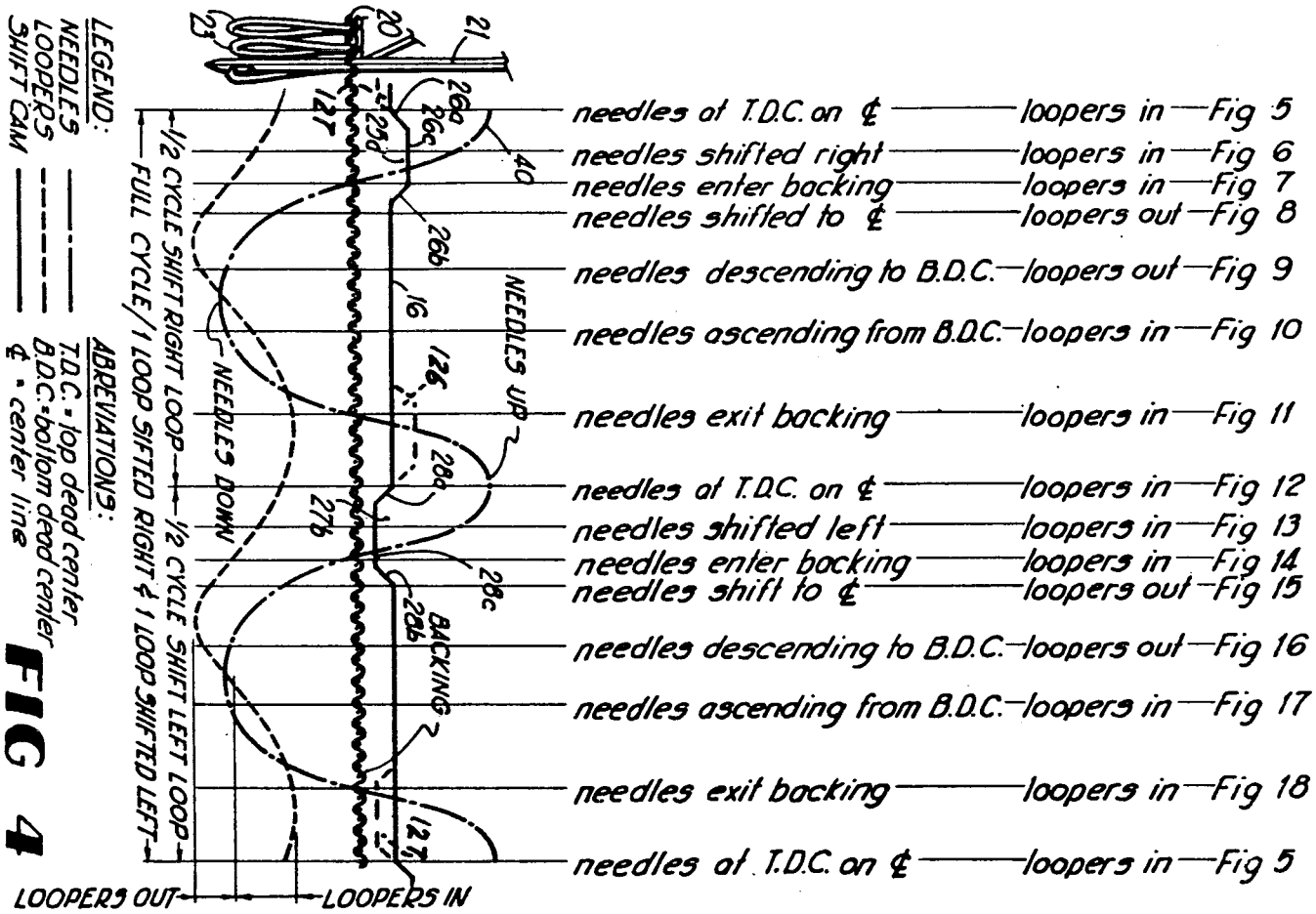
FIG. 4 is a schematic diagram depicting the respective positions of the needles, loopers and cam during a typical operation of the tufting machine depicted in FIG. 1, the broken lines for the cam showing an alternate manner of shifting.
Figure 5:
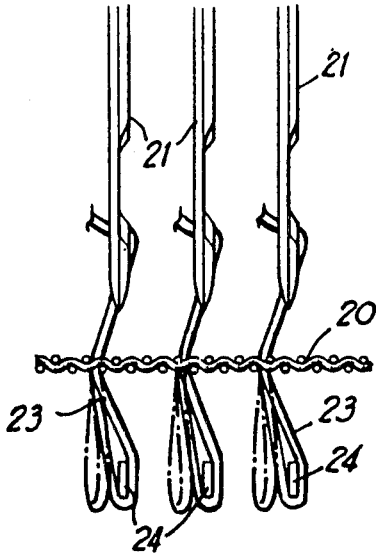
FIGS. 5–18 are fragmentary side elevational views of a portion of the needle bar of the tufting machine depicted in FIG. 1, the needle bar being illustrated in successive figures as moving through one cycle (two reciprocations of the needle bar) of the machine of the present invention.
Figure 6:
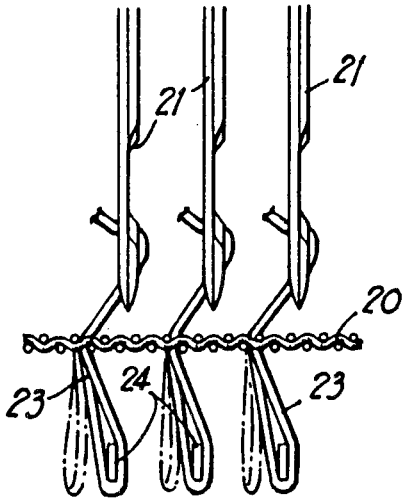

In the operation of the preferred embodiment of the machine of the invention, needles 21 begin a cycle at top dead center depicted in FIG. 5 of the drawing and being illustrated in FIG. 4 as the first position. In this position the loopers 24 are engaging the previously formed loops and the needles 21 are retracted or withdrawn out of the fabric. In FIG. 6, the needles 21 begin their travel downwardly and are shifted to the right by the cam follower 15*a* being received in a recess, such as recess 27*b*, and the cam follower 15*b* being engaged by a lobe 25*d*. It will be understood from FIG. 4 that the loopers 13 are still engaging the loops 23 to prevent a back drawing of the loops.

Figure 7:
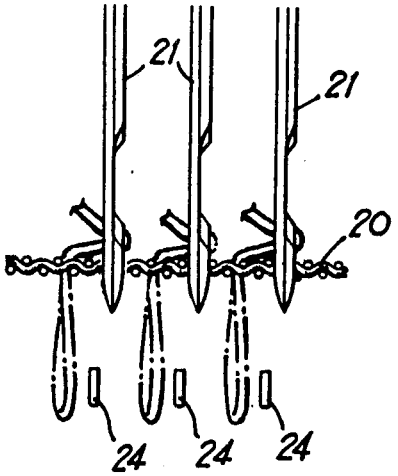

In FIG. 7, the needles are depicted as entering the backing material 20, with the loopes 24 still engaged in the previously formed loops 23. In the bottom portion of FIG. 4 it will be seen that the curve denoted by the numeral 40, depicts the position of the tip of a needle 21 with respect to the backing material 20 and that when the needles 21 are in the position, shown in FIG. 7, the tips of the needles 21 are just penetrating the backing material 20. It will also be seen that immediately after top dead center (T.D.C.) the leading edge 26*a* of the lobe 25*d* engages the follower 15*b* so as to begin the shifting of the control bar 19. By the time that the needles 21 have progressed downwardly and any appreciable distance, the needles 21 have been fully shifted to the right in FIG. 1 as a result of the follower 51*b* riding upon the flat or slightly arcuate central portion or surface 26*b* of the lobe 25*d*. As the needle 21 continues its travel downwardly to penetrate the backing material 20, as indicated in FIG. 4 by the broken line 40 passing the backing material 20 as depicted in FIG. 7, the cam follower 15*b* has reached the trailing edge or surface 26*b*. Further movement of the needles 21 so as to penetrate and engage the backing material 20, results in all of the needles 21 moving the penetrated increment of the backing material 20, which is closely adjacent to their points of penetration, to the left, as the follower 15*b* rides along the trailing edge or surface 26*c* of the lobe 25*d*. The shift laterally of the increment is only one-fourth the gauge of the machine and therefore is not sufficient to alter the overall linear path of travel of backing material 20.

Figure 8:
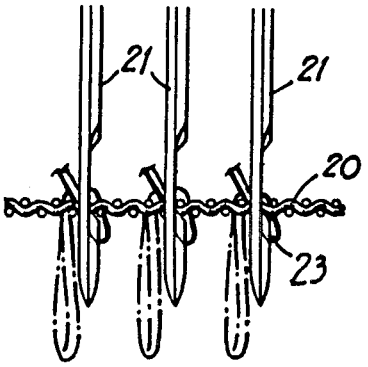

In FIG. 8, it is seen that the loopers 24 have released the previous loop 23, since the diagonal back stitch 30 has been laid down by the insertion of the needle 21 into the backing material 20. Since all needles 21 penetrated the backing material 20 before the cam follower 15*b* descended along the incline 26*c*, the lateral shifting of the increment of the backing material 20, which has been penetrated, will take place during the travel of the cam follower 15*b* along the incline surface 26*c*. This shifting of the backing material will correspond, in distance, to the height of the lobe 25*d*, i.e., the difference in the radius of the peripheral surface 16 and the radius of the surface 26*c*.

Figure 9:
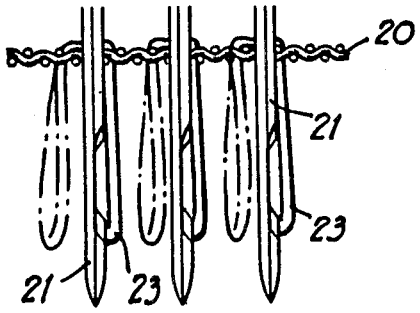
Figure 10:
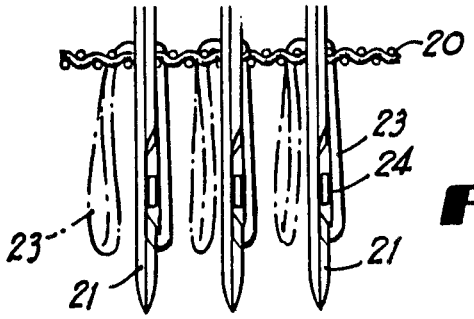

The needles 21 continue their descent until the needles 21 reach bottom dead center (B.D.C.) as depicted in FIG. 9. At that time, the loopers 24 are still not engaging the loops 23; however, the loops 23 have been inserted through the backing material 20 to the full extent of the travel of the needles 21.

When the needles 21 begin their ascent or retraction back toward top dead center, it will be understood that since the cam followers 15*a* and 15*b* both ride along the periphery 16 throughout this travel, the needles 21 travel along parallel linear vertical paths in registry with their loopers to top dead center.

Figure 11:
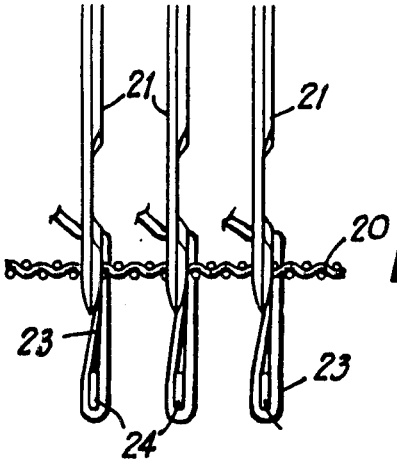

As the needles exit from the backing material, as shown in FIG. 11, the transverse increment of backing material 20, which has been previously shifted laterally, is released and due to the natural resiliency, i.e., the fact that the backing material has not been stretched beyond its elastic limints, and/or due to the tension applied by the tufting machine in a longitudinal direction of travel to the backing material 20, this increment moves laterally, returning to the normal straight linear path followed by the backing material 20.

Even if the backing material 20 is a non-resilient web or has been stretched beyond its elastic limits, the subsequent one-half cycle of the process (a 360° or one cycle travel for the needle bar 11) will have the effect of shifting the increment in the appropriate direction, because of the positive shifting by the needles 21 of the subsequent transverse increment as will now be described.

Figure 12:
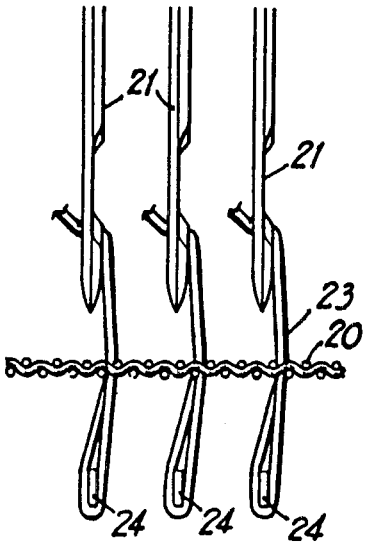
Figure 13:
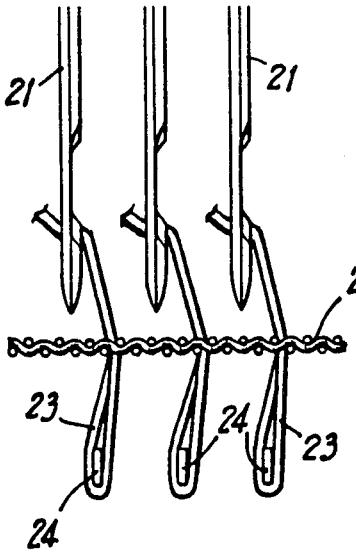
Figure 14:
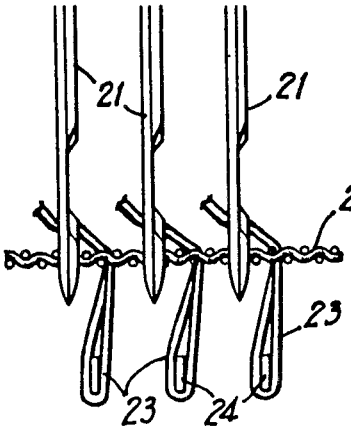

With the emergence of the needles 21 from the backing material, the needle bar 11 can be shifted laterally to the left, at any time prior to the needles 21 again entering the backing material. The tufting machine 10, however, is programmed by the cam 17 to accomplish the initial lateral shifting (left or right, as the case may be) for that half cycle of the process during an initial part of each down stroke. Thus, upon exiting as shown in FIG. 11, the needles 21 continue their travel in their linear vertical paths, to top dead center, as shown in FIG. 12, whence the needles 21 again begin their descent from the FIG. 12 position to the FIG. 13 position. During this travel, cam follower **15*b* passes into valley 27*b* as cam follower 15*a* ride on lobe 25*b*, the effect being that the needle bar 11 is shifted left by one-fourth the distance between axes of adjacent needles 21 and the needles 21 descend to their penetrating position as shown in FIG. 14**, while being so shifted.

Figure 15:
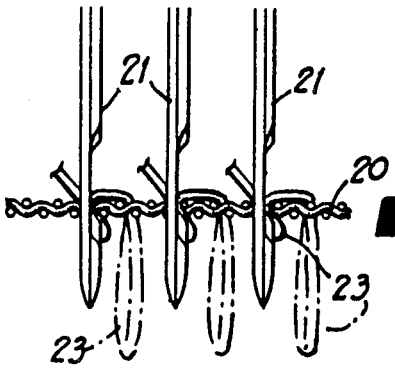
Figure 16:
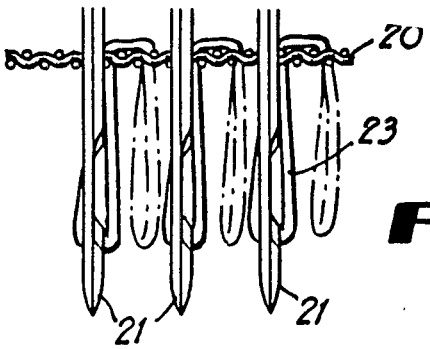
Figure 17:
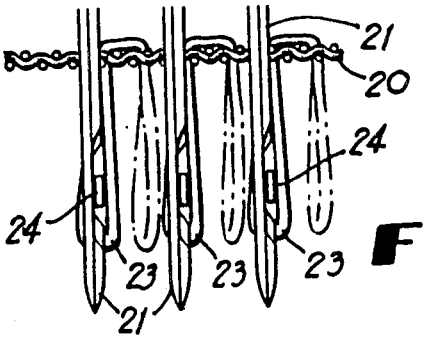
Figure 18:
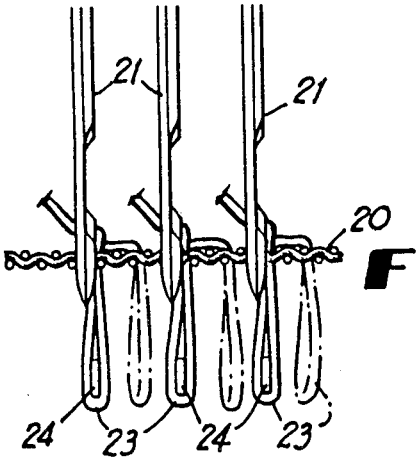

After entry, the progressive rotation of cam 17 removes the lobe from follower **15*a* and removes valley 27*b* from follower 15*b*, thereby causing a right shift so as to return the needle 21 to their unshifted or normal or centerline position, as depicted in FIG. 15. The needles 21 continue their downward travel to bottom dead center as illustrated in FIG. 16, and then begin their ascent, as illustrated in FIG. 17. As in the previous one half cycle, the loopers 24 engage the loops 23 while the needles 21 travel upwardly along their normal centerline axes, the needles 21 traveling linearly along these axes during the entire period in which they are ascending from bottom dead center to top dead center. As the needles exit, the backing material 20, the resiliency or springiness of the material cause the second increment of material which has been provided with the loops to spring back laterally into their original path of linear travel. The needles 21 then continue their upward travel to the top dead center position as depicted in FIG. 5** and commence another cycle of the process or machine.

With backing material 20 which does not readily spring back to its linear travel position, double shifting of the backing material 20 by the needles 21 during a single cycle of the machine will solve this problem. In the alternate form of operation, as depicted in FIG. 4, this double lateral shifting of the backing material 20 is accomplished by providing the periphery of cam 17 with twice the number of lobes and valleys, a lobe 126occurring immediately prior to each valley **27*a*, 27*b*, 27*c*, 27*d*, 27*e* and a valley 127 occurring immediately prior to each lobe 25*a*, 25*b*, 25*c*, 25*d*, 25*e***.

When the machine is operated in this alternate mode, the needles are first shifted in one lateral direction while they are free of the backing 20, then the needles 21 are inserted in the backing and shifted in the other lateral direction for accomplishing its tufting operation, as described for the preferred operation; however, the additional lobes 126 and valleys 127 causes the needles 21 to be shifted laterally, a second time, during each upstroke, and prior to the retraction of the needles 21 from the backing material 20, the shifting being in the same direction and to the same extent as the shifting took place during the initial portion of the cycle when the needles 21 were free of the backing material 20. The result, therefore, is that the increment of the backing material 20 which was shifted in one direction for the tufts inserting operation is shifted by the needles 21 back to its original linear path of travel, before the needles 21 are retracted from the backing material 20.

While we have chosen to describe the needles as shifting by one-fourth the gauge of the machine, so as to produce two rows of tufts spaced apart by one half the gauge, it will readily be understood that the needles 21 can be shifted by any increment desired or shifted successively from the normal position in only one direction, rather than in alternate directions. Thus, any reasonable number of longitudinal lines of tufts can be produced using a single needle 21 by shifting it appropriately to the left or right, as desired. Of course, a longitudinal line of tufting can be produced by cycling the needles 21 without shifting them at all.

The present invention is equally applicable to tufting machines for producing both cut pile and loop pile, it being understood that the term "looper" or "looper means" applies equally to a loop pile looper or to the cut pile looper and the knife. When I state that the loop is released by the looper or the hook of the looper, I mean that the loop 12 can be released as a loop or can be servered by a knife and hence released as cut pile. The looper can be a single looper or a plurality of loopers in vertical alignment such as in a combination cut and loop pile machine wherein certain of the loops formed by a single needle are cut and others are uncut. The machine and process of the present invention is particularly suited for use in such combination cut and loop pile machines since the looper construction for each needle has, in the past, limited the narrowness of the gauge of the machine to relatively wide distances between adjacent needles.

It will be obvious to those skilled in the art that many variations may be made in the embodiment chosen for the purpose of illustrating the invention without departing from the scope thereof as defined by the claims.

We claim:

1. A method of tufting pile fabric comprising, feeding a backing material in one direction, reciprocably penetrating a plurality of needles carrying yarns through said backing material from one side thereof, said needles being spaced apart transversely to said feed direction, shifting said needles from a first position transversely to said direction while said needles are on one side of said material and spaced therefrom, penetrating said material with said needles, and shifting said needles to said first position while said needles are within the backing material and withdrawing said needles from said backing material to form loops of said yarns in said backing material.

2. A method as recited in claim 1, wherein the amount of shift in each direction is less than the spacing between adjacent needles.

3. The method as recited in claim 2, wherein the amount of shift in each direction may be selectively varied.

4. In a tufting machine, means for feeding a base material in one direction, a plurality of yarn carrying needles spaced apart transversely to said one direction, means for reciprocating said needles to penetrate the base material and to form loops therein, means for mounting said needles for movement in a direction transverse to said one direction, pattern control means for shifting said needles from a first position while said needles are outside said base material and for shifting said needles back to said first position while said needles are within said base material.

5. In a tufting machine as recited in claim 4, wherein said drive means includes means for selectively varying the distance said needles and said fingers are shifted to and from said first position.

6. In a tufting machine as recited in claim 4, wherein said needles are carried by a transversely extending needle bar, said means for reciprocating said needles comprises a plurality of reciprocably driven push rods, said means for mounting said needles comprises means for drivingly connecting said needle bar to said push rods and permitting said needle bar to slide relatively to said push rods, said pattern control means comprising drive means moved transversely in accordance with a pattern, and means for connecting said drive means to said needle bar.

7. In a tufting machine as recited in claim 4, wherein said pattern control means comprises a peripheral cam rotatably driven in timed relationship to the reciprocation of said needles, follower means, drive means supporting said follower means in engagement with the periphery of said cam and constrained for transverse movement, and means for connecting said drive means to said needles.

* * * * *